US011624344B2

(12) United States Patent
Noguchi et al.

(10) Patent No.: US 11,624,344 B2
(45) Date of Patent: Apr. 11, 2023

(54) FUEL SUPPLY DEVICE

(71) Applicant: AISAN KOGYO KABUSHIKI KAISHA, Obu (JP)

(72) Inventors: Syuhei Noguchi, Okazaki (JP); Koji Yoshida, Commerce Township, MI (US); Satoshi Ito, Toyohashi (JP); Kensuke Niwa, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 113 days.

(21) Appl. No.: 17/042,237

(22) PCT Filed: Feb. 19, 2019

(86) PCT No.: PCT/JP2019/006075
§ 371 (c)(1),
(2) Date: Sep. 28, 2020

(87) PCT Pub. No.: WO2019/187794
PCT Pub. Date: Oct. 3, 2019

(65) Prior Publication Data

US 2021/0115885 A1 Apr. 22, 2021

(30) Foreign Application Priority Data

Mar. 28, 2018 (JP) ..... JP2018-061620

(51) Int. Cl.
*F02M 37/10* (2006.01)

(52) U.S. Cl.
CPC ..... *F02M 37/103* (2013.01)

(58) Field of Classification Search
CPC .... F02M 37/00; F02M 37/0007; F02M 37/10; F02M 37/103; F02M 37/106
See application file for complete search history.

(56) References Cited

U.S. PATENT DOCUMENTS

| | | | | |
|---|---|---|---|---|
| 9,951,729 | B2 | 4/2018 | Fukui et al. | |
| 2017/0248106 | A1* | 8/2017 | Niwa | F02M 37/10 |
| 2017/0268470 | A1* | 9/2017 | Murakoshi | F02M 37/00 |

(Continued)

FOREIGN PATENT DOCUMENTS

| | | | |
|---|---|---|---|
| JP | 2003049729 | A | 2/2003 |
| JP | 2016044646 | A | 4/2016 |

(Continued)

OTHER PUBLICATIONS

PCT/JP2019/006075 International Preliminary Report on Patentability dated Sep. 29, 2020 (5 p.).

(Continued)

*Primary Examiner* — John Kwon
*Assistant Examiner* — Johnny H Hoang
(74) *Attorney, Agent, or Firm* — Conley Rose, P.C.

(57) ABSTRACT

A fuel supply device is insertable into a fuel tank through an opening formed in an upper wall of the fuel tank in an insertion direction. The fuel supply device includes a flange unit and a pump unit coupled to the flange unit. The pump unit includes a guide member extending in the insertion direction. The guide member is configured to abut on an opening periphery so as to guide the pump unit when the pump unit is inserted into the fuel tank. A guide surface of the guide member includes a concave surface.

9 Claims, 8 Drawing Sheets

(56) References Cited

U.S. PATENT DOCUMENTS

| | | | | |
|---|---|---|---|---|
| 2017/0268471 | A1* | 9/2017 | Fukui | F02M 37/10 |
| 2019/0178211 | A1 | 6/2019 | Maruyama et al. | |

FOREIGN PATENT DOCUMENTS

| | | | |
|---|---|---|---|
| JP | 2017145800 | A | 8/2017 |
| JP | 2018080677 | A | 5/2018 |

OTHER PUBLICATIONS

English Translation of PCT/JP2019/006075 International Preliminary Report on Patentability dated Sep. 29, 2020 (6 p.).
PCT/JP2019/006075 International Search Report and Written Opinion dated May 21, 2019 (9 p.).
German Patent Application No. 11 2019 000 999.0 Office Action dated Jun. 8, 2022 (11 pages).

* cited by examiner

FUEL SUPPLY DEVICE

CROSS-REFERENCE TO RELATED APPLICATIONS

The present application is a 35 U.S.C. § 371 national stage application of, and claims to the benefit of, PCT Application No. PCT/JP2019/006075 filed Feb. 19, 2019, which claims priority to Japanese Patent Application No. 2018-061620 filed Mar. 28, 2018, each of which is incorporated herein by reference in its entirely for all purposes.

STATEMENT REGARDING FEDERALLY SPONSORED RESEARCH OR DEVELOPMENT

Not applicable.

BACKGROUND

The present disclosure relates generally to fuel supply devices.

A fuel tank for a vehicle (e.g., an automobile or the like) is preferably of a thin, flat type to meet the demand for reducing the height of the vehicle. Since the fuel tank houses a fuel supply device therein, the height of the fuel supply device in the upward/downward direction also needs to be lowered. For this reason, one type of fuel supply device has a modular structure including an upper unit and a lower unit, with the upper unit being connected to the lower unit by a connecting means that allows the upper unit to be rotatable and movable in the upward/downward direction relative to the lower unit. The fuel supply device is inserted into the fuel tank through an opening formed at an upper wall of the fuel tank.

The upper unit of the fuel supply device is a flange unit including a cover plate configured to close the opening formed at the upper wall of the fuel tank. The lower unit is a pump unit including a fuel pump disposed on a bottom wall of the fuel tank. The pump unit passes through the opening of the fuel tank first as the fuel supply device is installed in the fuel tank. The diameter of the opening is set to the minimum necessary to ensure the strength of the fuel tank. The pump unit transitions from a vertically orientation to a horizontal orientation as the fuel supply device is inserted into the fuel tank.

SUMMARY

In one aspect of the present disclosure, a fuel supply device to be inserted into a fuel tank through an opening defined by an opening periphery of an upper wall of the fuel tank includes a flange unit and a pump unit moveably coupled to the flange unit. The flange unit includes a cover plate configured to close the opening of the upper wall of the fuel tank. The pump unit is configured to rotate and move in an upward/downward relative to the flange unit. The pump unit includes a fuel pump configured to face a bottom wall of the fuel tank. The pump unit includes a guide member oriented in an insertion direction. The guide member is configured to abut the opening periphery so as to guide the pump unit when the pump unit is inserted into the fuel tank. In particular, a guide surface of the guide member is configured to abut the opening periphery and includes a concavely curved shape.

According to the above aspect, the pump unit of the fuel supply device includes the guide member. The guide surface of the guide member comes into contact with the opening periphery so as to guide the pump unit when the pump unit is inserted into the fuel tank through the opening. This allows the fuel supply device to be smoothly inserted into the fuel tank without being caught by the opening periphery.

In addition, according to the above aspect, the guide surface of the guide member is formed in a concavely curved shape. Therefore, when inserting the pump unit through the opening, an insertion gap (i.e., a gap defined between the opening periphery and the pump unit) becomes larger by a gap formed by the concavely curved shape of the guide member compared with the case where the guide surface of the guide member is formed in a straight shape. As a result, the pump unit can be inserted into the fuel tank with a margin such that the insertability can be further improved.

DETAILED DESCRIPTION

As previously described, some fuel supply devices include a flange unit with a cover plate configured to close the opening formed at the upper wall of the fuel tank and a pump unit including a fuel pump disposed on a bottom wall of the fuel tank. The diameter of the opening is set to the minimum necessary to ensure the strength of the fuel tank. Consequently, during installation of the fuel supply device, the pump unit transitions from a vertically orientation to a horizontal orientation as the fuel supply device is inserted into the fuel tank. In some cases, the fuel supply device is not smoothly and easily inserted into the fuel tank because components of the fuel supply device, particularly the components of the pump unit, may get caught by the periphery of the opening of the upper wall during insertion of the pump unit into the fuel tank while being rotated to the horizontal orientation.

To address the foregoing problem, Japanese Laid-Open Patent Publication No. 2016-44646 discloses a structure where a pump unit includes a guide member to allow the pump unit as well as a fuel supply device to pass smoothly through the opening when the guide member comes into contact with the periphery of the opening.

The insertion of the fuel supply device into the fuel tank has been improved by the above-described guide member. However, further improvement in insurability has been desired to facilitate a mounting process for installing the fuel supply device into the fuel tank.

Figure 1:
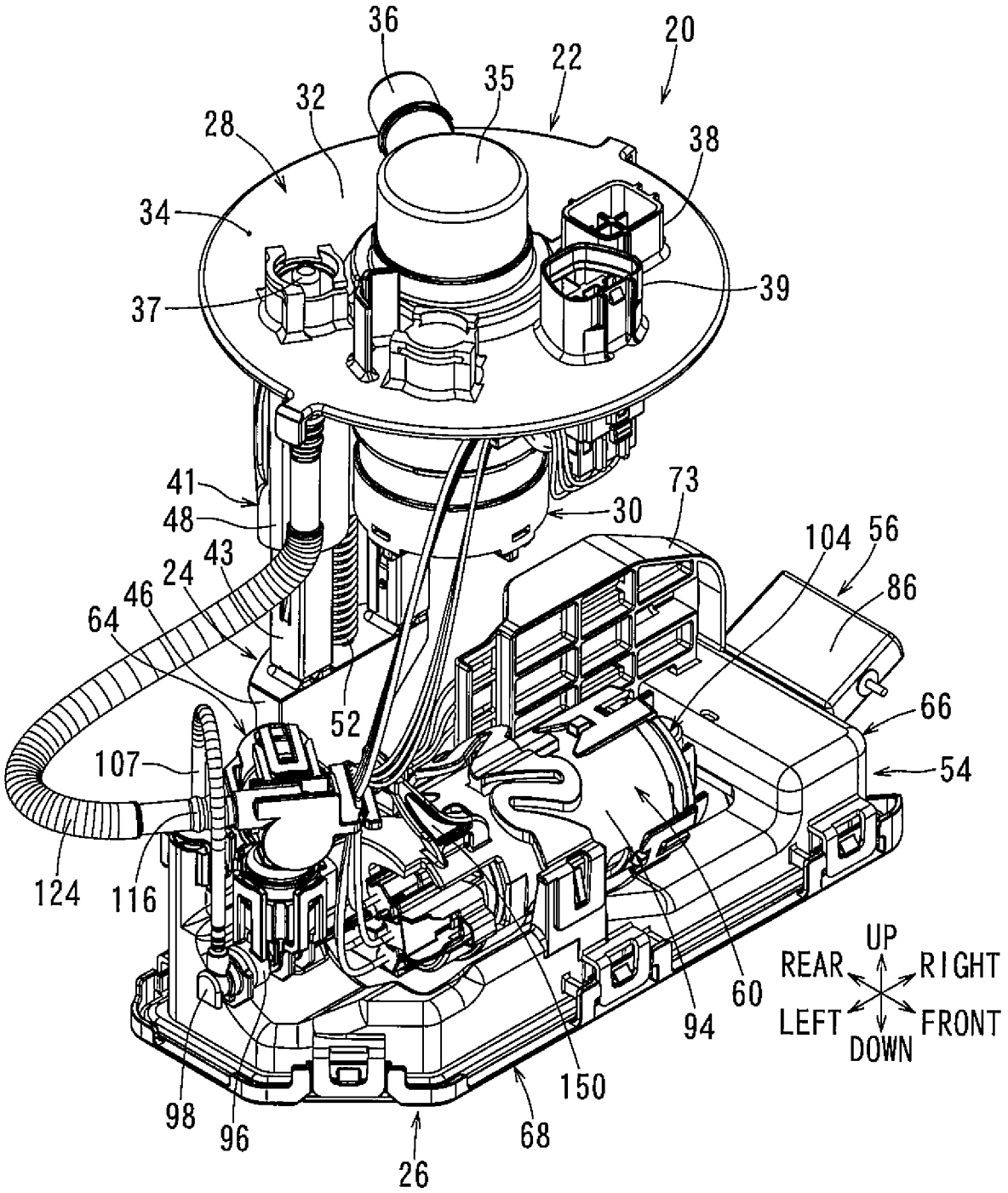
FIG. 1 is a perspective view of a fuel supply device according to one embodiment.
Figure 2:
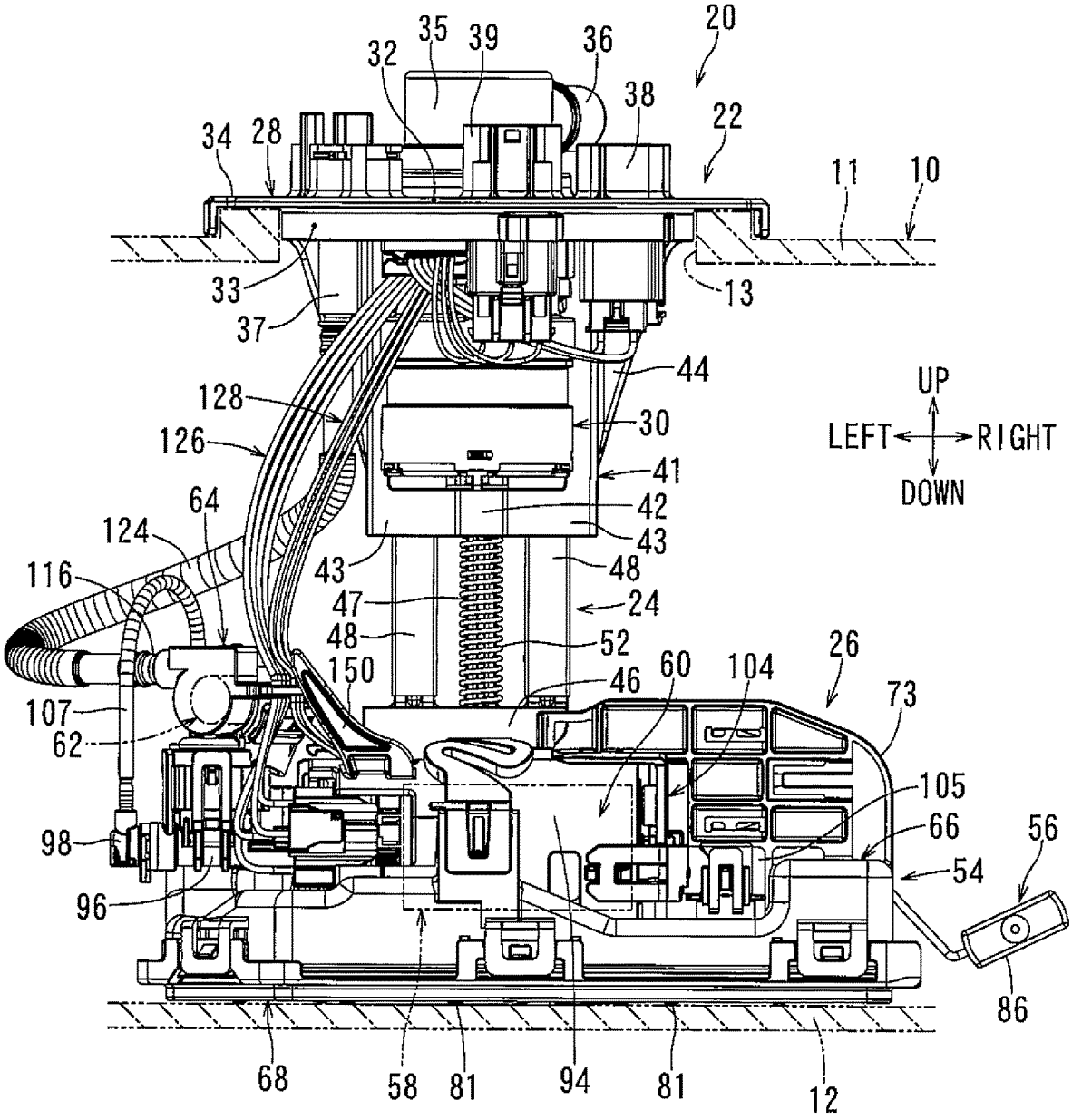
FIG. 2 is a front view of the fuel supply device of FIG. 1.
Figure 3:
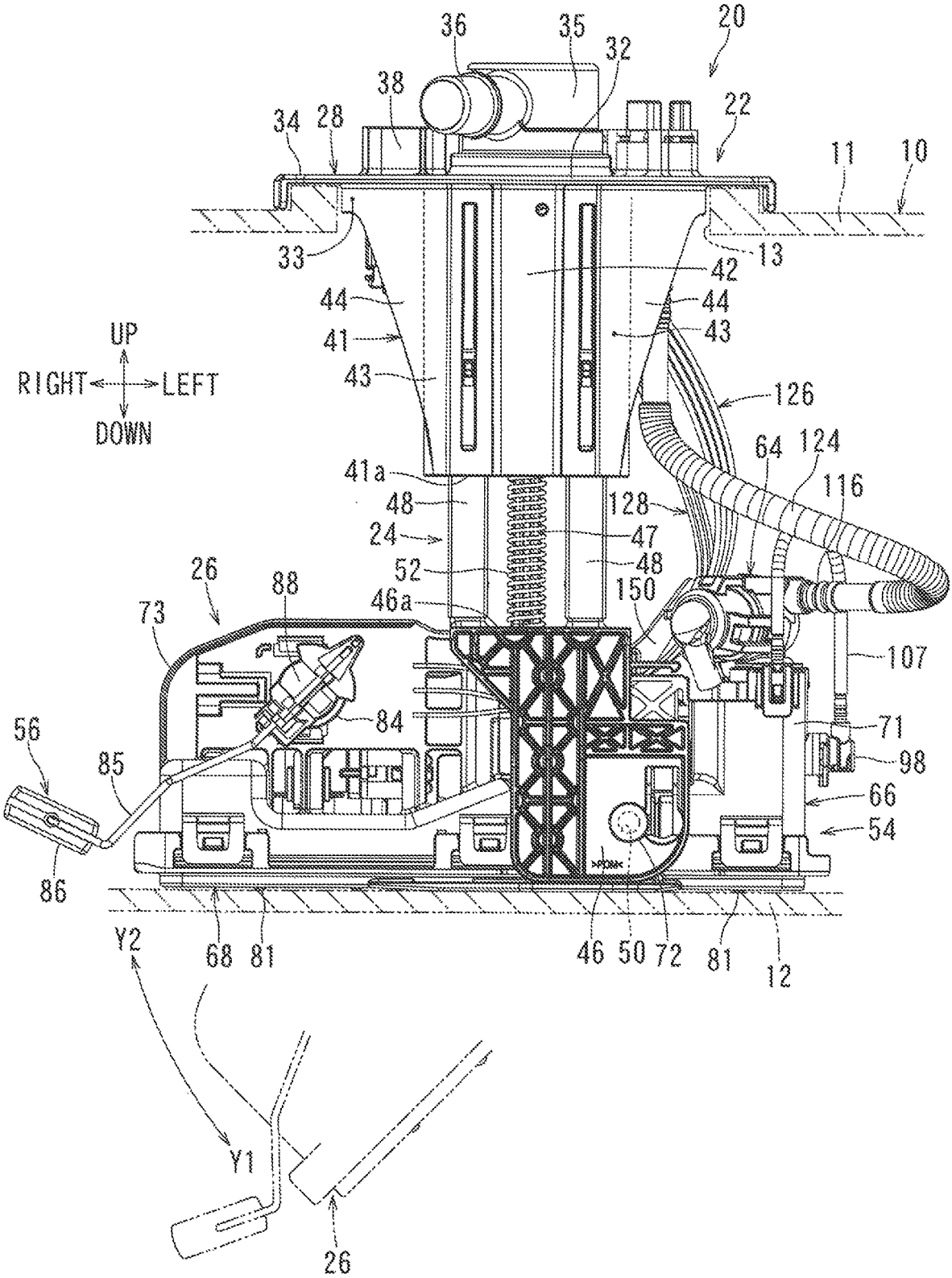
FIG. 3 is a rear view the fuel supply device of FIG. 1.

Hereinafter, one embodiment will be described with reference to the drawings. A fuel supply device may be installed in the fuel tank mounted on a vehicle (e.g., an automobile or the like) equipped with an engine (e.g., an internal combustion engine), and may serve to supply fuel within the fuel tank to the engine. FIG. 1 is a perspective view of an embodiment of a fuel supply device. FIG. 2 is a front view of the same. FIG. 3 is a rear view of the same. In FIGS. 1 to 3, the frontward, rearward, leftward, rightward, upward, and downward directions are shown and correspond to directions of a vehicle. More specifically, the frontward/rearward direction corresponds to a vehicle length direction, the leftward/rightward direction corresponds to a vehicle width direction, and the upward/downward direction corresponds to a vehicle height direction. The frontward/rearward direction and the leftward/rightward direction of the fuel supply device may be oriented in any direction.

As shown in FIG. 2, a fuel tank 10 may be formed as a hollow container having an upper wall 11 and a bottom wall 12. The upper wall 11 may have an opening periphery 13 defining an opening that has a circular through-hole shape. The inside and outside of the fuel tank 10 are in communication with each other via the opening. The fuel tank 10 may be mounted on a vehicle such that the upper wall 11 and the bottom wall 12 extend horizontally. The fuel tank 10 may be made of resin and may deform, i.e. expand or contract mainly in the upward/downward direction, in response to change in tank internal pressure. For example, liquid fuel, such as gasoline, may be stored in the fuel tank 10.

As shown in FIG. 1, a fuel supply device 20 includes a flange unit 22, a joint member 24, and a pump unit 26. The joint member 24 is connected to the flange unit 22 so as to be movable in the upward/downward direction relative thereto, and the pump unit 26 is connected to the joint member 24 so as to be rotatable in the upward/downward direction relative thereto. A connecting means of the present disclosure may be configured with this structure and functionality.

As shown in FIGS. 1 and 2, the flange unit 22 includes a flange main body 28 and a fuel vapor valve 30.

As shown in FIG. 1, the flange main body 28 comprises a cover plate 32 having a circular plate shape as a main body. The flange main body 28 may be made of resin. As shown in FIG. 2, a fitting tubular portion 33 having a short cylindrical shape is concentrically formed on a lower surface of the cover plate 32. An annular disc-like flange portion 34 extends radially outward from the fitting tubular portion 33 around an outer periphery of the cover plate 32. A valve housing 35 having a closed-topped cylindrical shape is concentrically formed on the cover plate 32. An evaporation port 36 extends radially outward from an upper end of the valve housing 35.

As shown in FIG. 1, a fuel outlet port 37, a first electric connector portion 38, and a second electric connector portion 39 are provided on the cover plate 32. The fuel outlet port 37 is a straight tube extending through the cover plate 32 in the upward/downward direction. A predetermined number of metal terminals are disposed in both electric connector portions 38, 39. The fuel outlet port 37 and both electric connector portions 38, 39 are circumferentially-spaced around the valve housing 35.

As shown in FIG. 3, a standoff portion 41 is disposed on a rear side of the lower surface of the cover plate 32. The standoff portion 41 includes a center tubular portion 42, a left side tubular portion 43, and a right side tubular portion 43. Each tubular portion 42, 43 has a tubular shape extending in the upward/downward direction. The center tubular portion 42 and both side tubular portions 43 are formed symmetrically in the leftward/rightward direction. In this embodiment, the center tubular portion 42 shares its right side wall portion with one of the side tubular portions 43 and shares its left side wall portion with the other of the side tubular portions 43. A pair of left and right curved wall portions 44 extend outward from both side tubular portions 43 in a symmetric manner in the leftward/rightward direction. Rear side wall portions of the center tubular portion 42, the rear side walls of both side tubular portions 43, and both curved wall portions 44 are continuous with a rear half of the fitting tubular portion 33 of the flange main body 28. Both curved wall portions 44 have a substantially triangular shape, which is tapered downward from the fitting tubular portion 33 as viewed from the back.

As shown in FIG. 2, the fuel vapor valve 30 may be attached to the valve housing 35 such that the top portion of the fuel vapor valve 30 is accommodated within the valve housing 35 of the flange main body 28. As the fuel vapor valve 30, an integrated valve having, for example, a fuel vapor control valve and a full-tank regulating valve may be used. The fuel vapor control valve closes when the internal pressure in the fuel tank is smaller than the predetermined value, and opens when the internal pressure becomes greater than the predetermined value. Further, the full-tank regulating valve opens when fuel in the fuel tank 10 is not full, and closes when filled full with fuel.

As shown in FIG. 3, the joint member 24 includes a joint main body 46, a spring guide 47, a left side columnar portion 48, and a right side columnar portion 48. The joint main body 46 may be made of resin, and may be formed in a flat shape shortened in the frontward/rearward direction. The joint member 24 has an upper end face **46*a* extending horizontally. An engagement hole 50 extends through a lower portion of the joint main body 46 in the frontward/rearward direction. In this embodiment, the spring guide 47 is formed like a strut extending in the upward/downward direction from the center of the upper end face 46*a* of the joint main body 46. Each side columnar portion 48 has a rectangular columnar shape extending in the upward/downward direction. Both side columnar portions 48 are arranged symmetrically on the left and right ends of the upper end face 46*a* of the joint main body 46**.

A spring 52 comprising a metal coil spring may be fitted to the spring guide 47 of the joint member 24. The spring guide 47 of the joint member 24 may be inserted into the center tubular portion 42 of the flange main body 28 together with the coil spring 52. Further, both side columnar portions 48 of the joint member 24 may be inserted into both side tubular portions 43 of the flange main body 28. Furthermore, both side tubular portions 43 may be connected to both side columnar portions 48 by snap-fitting so as to be movable in the axial direction within the predetermined range. Moreover, the spring 52 biases the flange body 28 and the joint main body 46 due to elasticity of the spring 52 in a direction separating from each other.

Figure 4:
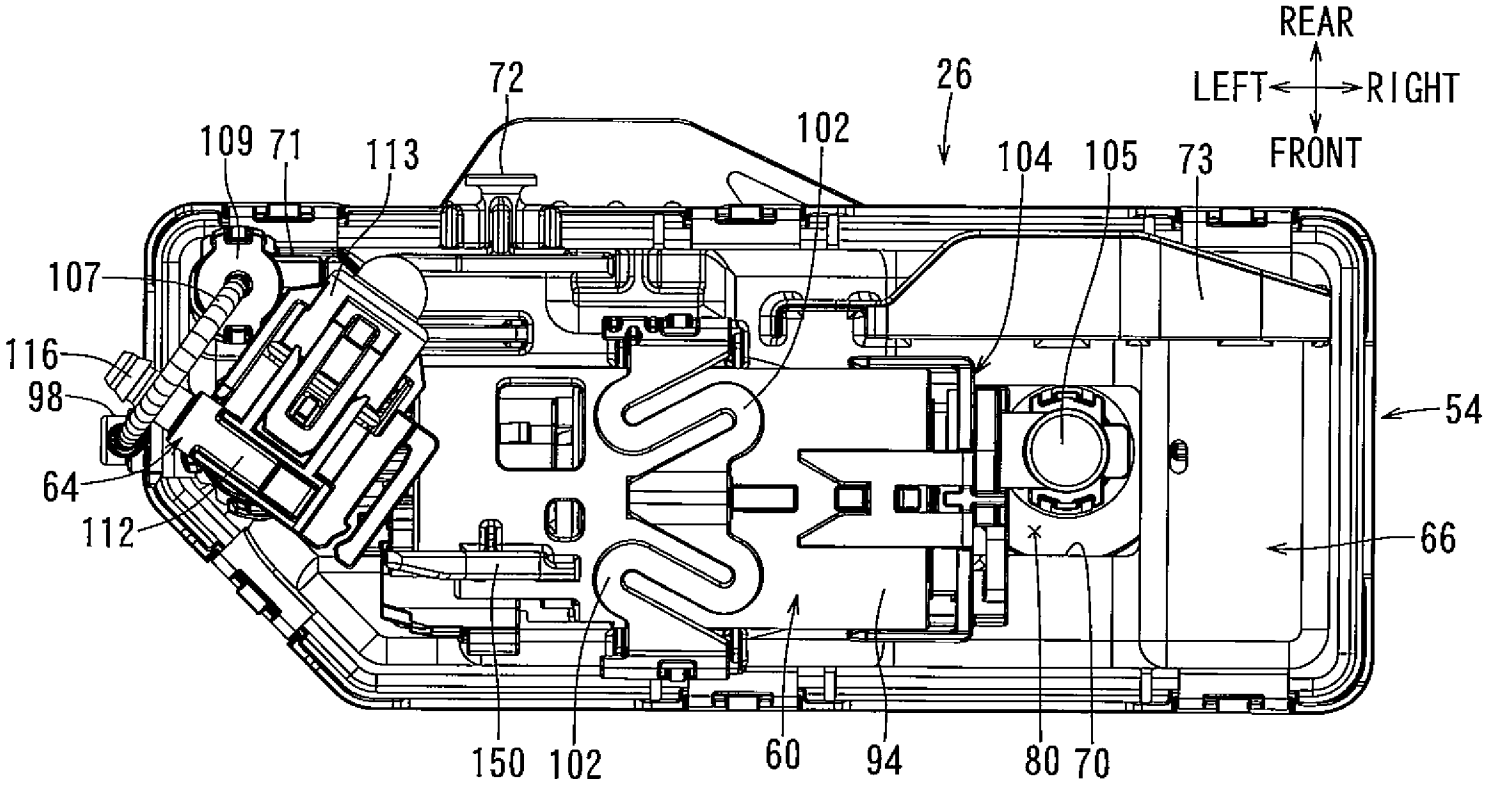
FIG. 4 is a top view of the pump unit of FIG. 1.
Figure 5:
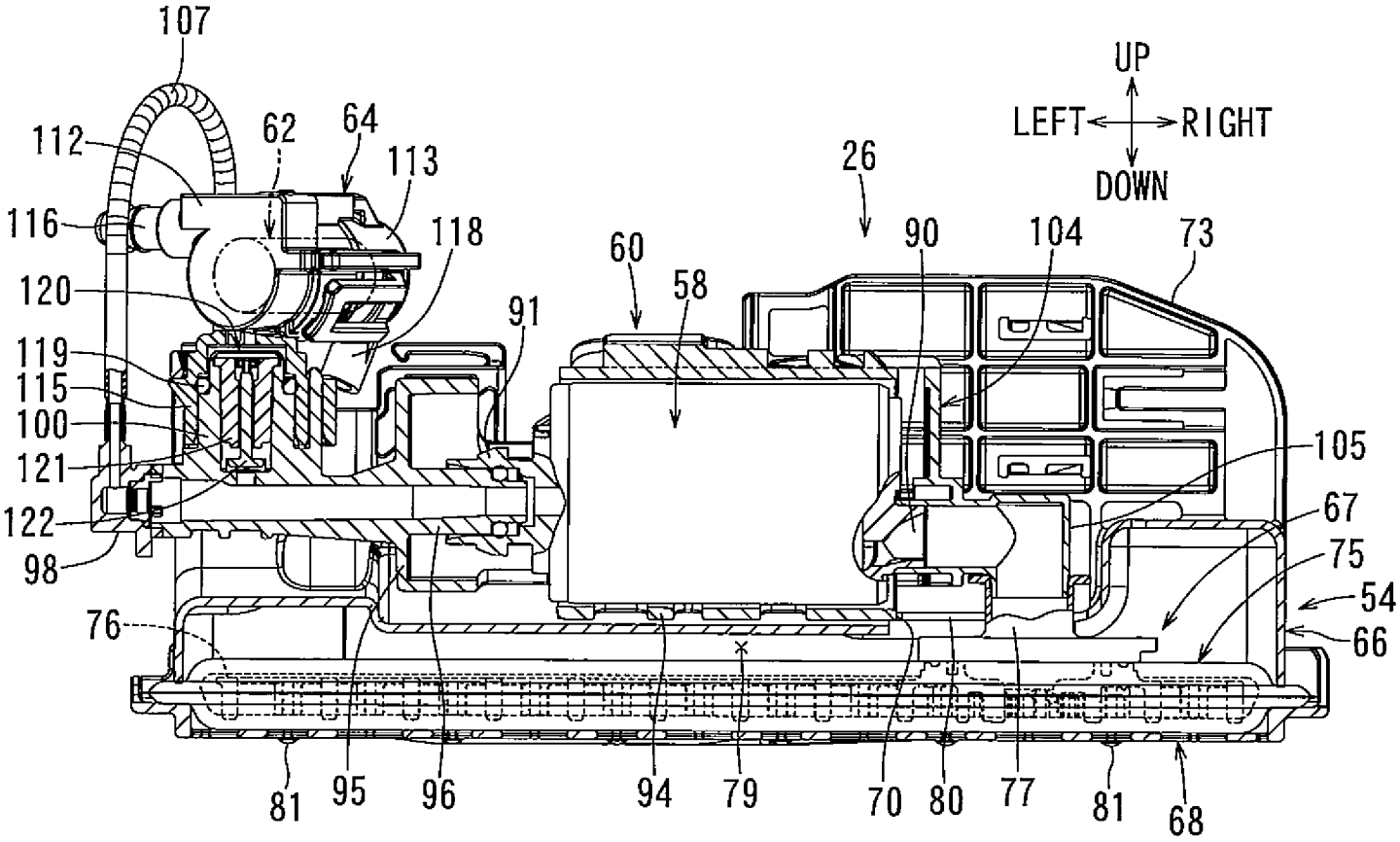
FIG. 5 is a front, partially cutaway view of the pump unit of FIG. 4.

As shown in FIG. 2, the pump unit 26 includes a sub-tank 54, a sender gauge 56, a fuel pump 58, a pump case 60, a pressure regulator 62, and a regulator case 64. FIG. 4 is a top of the pump unit 26. FIG. 5 is a partially cutaway front view of the same. The sender gauge 56 is not shown in FIG. 4.

As shown in FIG. 5, the sub-tank 54 includes a sub-tank main body 66, a fuel filter 67, and a cover member 68.

The sub-tank main body 66 may be made of resin and formed in a shallow box shape, which has an open bottom and a low height. In particular, the sub-tank main body 66 may be formed to have a rectangular shape elongated in the leftward/rightward direction in a top view (see FIG. 4). A rectangular opening hole 70 is formed between the center and the right end on the top side of the sub-tank main body 66. A fuel receiving tubular portion 71 is formed to the left rear of the top side of the sub-tank main body 66 (see FIG. 4). The fuel receiving tubular portion 71 has a rectangular tubular shape extending upwardly. The top side of the fuel receiving tubular portion 71 is opened.

As shown in FIG. 3, a rearward projecting engagement shaft 72 is provided to the left on a lower portion of the rear side of the sub-tank main body 66 (see FIG. 4). Further, as shown in FIG. 4, the sub-tank main body 66 includes a plate-like upright wall 73 facing the frontward/rearward direction on the right rear portion of the top side of the sub-tank main body 66.

As shown in FIG. 5, the fuel filter 67 includes a filter member 75, an inner frame member 76, and a connecting pipe 77. The filter member 75 has a hollow bag shape with a filter material made of resin non-woven fabric. A contour of the filter member 75 has an elongated rectangular shape, which is flat in the upward/downward direction has a length in the leftward/rightward that is greater than a width in the frontward/rearward direction.

The inner frame member 76 may be made of resin and have a skeleton structure that retains the filter member 75 in an expanded or inflated state in the upward/downward direction. Further, the connecting pipe 77 may be made of resin and has a round tube shape extending in the upward/downward direction. The connecting pipe 77 is joined on the right portion of the inner frame member 76 by heat fusion. An upper side of the filter member 75 is interleaved between the inner frame member 76 and the connecting pipe 77. The inside and the outside of the filter member 75 may be in fluid communication via the connecting pipe 77.

The filter member 75 is arranged so as to close the bottom opening of the sub-tank main body 66. A fuel storage space 79 for storing fuel is provided between the sub-tank main body 66 and the filter member 75. The connecting pipe 77 is disposed within the opening hole 70 of the sub-tank main body 66. An edge of the opening hole 70 and the connecting pipe 77 defines an annular space serving as a fuel flow inlet 80. The fuel in the fuel tank 10 (see FIG. 2 and FIG. 9) may flow into the fuel storage space 79 through the flow inlet 80 under its own weight.

The cover member 68 has an elongated rectangular plate shape including a plurality of openings. The cover member 68 may be made of resin. The cover member 68 is coupled to the sub-tank main body 66 by snap-fitting. A peripheral edge of the filter member 75 is interleaved between peripheral edges of the sub-tank main body 66 and the cover member 68. The cover member 68 covers a lower side of the filter member 75. A plurality of semi-spherical projections 81 are formed on a lower side of the cover member 68.

As shown in FIG. 3, the sender gauge 56 includes a gauge main body 84, an arm 85, and a float 86. The gauge main body 84 is attached to a rear side of the upright wall 73 of the sub-tank main body 66. The gauge main body 84 includes a rotating portion 88, which rotatably couples the arm 85 to the gauge main body 84, thereby allowing the arm to rotate about a horizontal axis. A base end portion of the arm 85 is attached to the rotating portion 88. The arm 85 has a free end portion coupled to the float 86. The sender gauge 56 is a liquid level meter configured to detect a residual amount of fuel in the fuel tank 10, i.e., a position of the liquid level.

Figure 6:
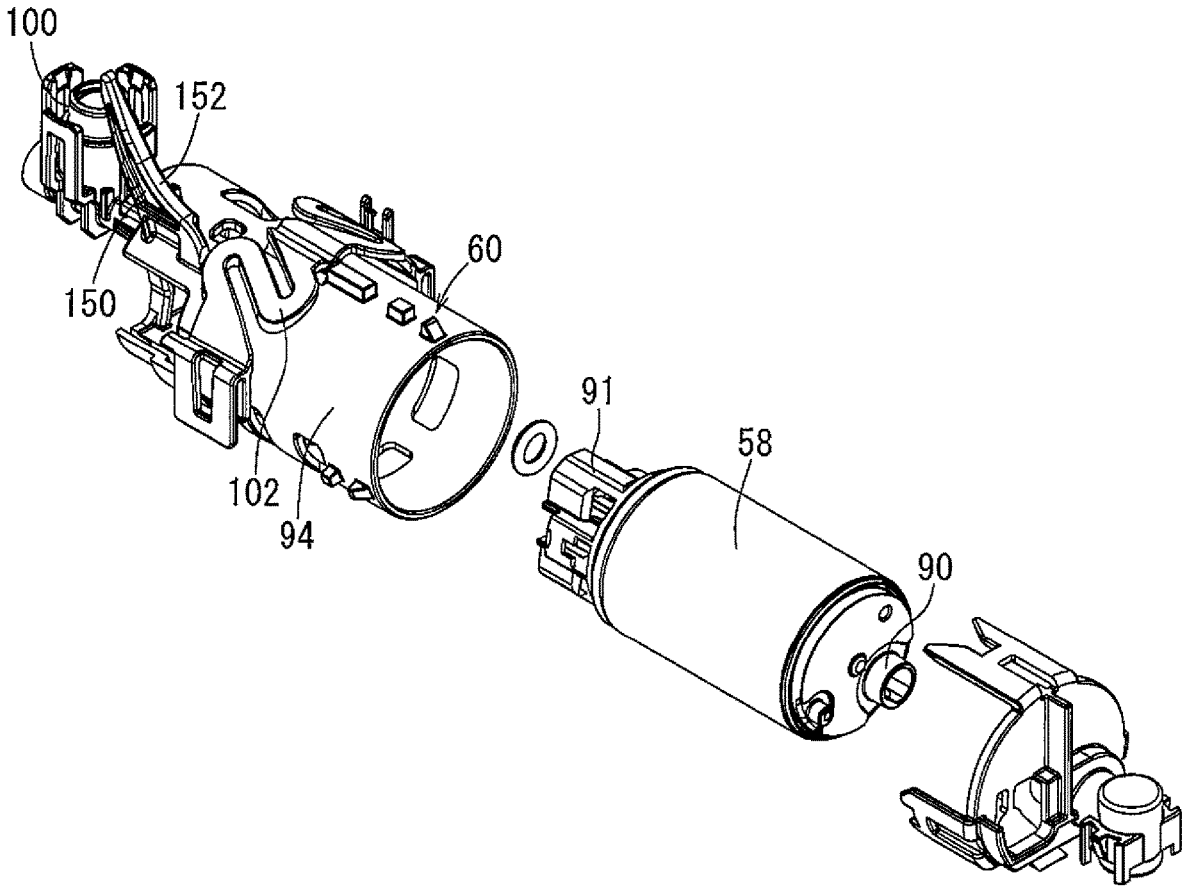
FIG. 6 is a perspective, exploded view of the pump case and the fuel pump of FIG. 1.

As shown in FIGS. 5 and 6, the fuel pump 58 may be an electric fuel pump formed in a substantially cylindrical columnar shape. The fuel pump 58 includes a motor portion and a pump portion that function to draw, pressurize, and discharge the fuel. The fuel pump 58 includes a fuel suction port 90 on a pump portion side end (right end) and a fuel discharge port 91 on a motor portion side end (left end). Further, the fuel pump 58 includes an electric connector on the motor portion side end thereof. For example, a brushless DC motor may be used for the motor portion.

As shown in FIGS. 5 and 6, the pump case 60 includes a case main body 94 having a hollow cylindrical shape extending in the leftward/rightward direction. The pump case 60 may be made of resin. The case main body 94 includes an end plate 95 closing a left end of the case main body 94. The end plate 95 includes a discharge pipe portion 96 formed as a straight tube. The discharge pipe portion 96 extend leftward through the center of the end plate 95. A pipe joint 98 is joined at a left end of the discharge pipe portion 96 by welding. The pipe joint 98 may be made of resin and may define an L-shaped passage therein. Further, the discharge pipe portion 96 includes a connecting tubular portion 100 protruding upward from a position proximal the left end of the discharge pipe portion 96. The connecting tubular portion 100 has a hollow cylindrical shape such that the inside of the connecting tubular portion 100 is in fluid communication with the inside of the discharge pipe portion 96. The fuel pump 58 is disposed in the case main body 94 with the fuel discharge port 91 oriented to the left. The fuel discharge port 91 is connected to the right end portion of the discharge pipe portion 96.

As shown in FIG. 4, a pair of front and rear elastic support pieces 102 are provided on an upper end of the lateral center of the case main body 94. The elastic support pieces 102 extend in opposite directions so as to be arranged symmetrically in the frontward/rearward direction. Each of the elastic support pieces 102 may have a strip shape curved in a substantially S-shape in a plan view. A front end of the front elastic support piece 102 and a rear end of the rear elastic support piece 102 may be integrally connected to a front side and a rear side of the sub-tank main body 66 by snap-fitting, respectively. Thus, the pump case 60 may be elastically supported on the sub-tank main body 66 in a horizontal state, i.e., a laterally placed state, by both elastic support pieces 102.

As shown in FIG. 5, a cap 104 is attached to a right end of the case main body 94 by snap-fitting so as to close a right end opening of the case main body 94. The cap 104 may be made of resin. The cap 104 includes a suction pipe portion 105 protruding rightward. The suction pipe portion 105 is formed in an L-shape such that a tip end part thereof is bent downward. A left end of the suction pipe portion 105 is connected to the fuel suction port 90 of the fuel pump 58. The other end, i.e. a lower end, of the suction pipe portion 105 is connected to the connecting pipe 77 of the fuel filter 67. The suction pipe portion 105 is coupled to the connecting pipe 77 with a snap-fitting.

As shown in FIG. 5, one end of a fuel discharge tube 107 made of a resin flexible tube is connected to the pipe joint 98 by press fitting. A nozzle member is connected to the other end of the fuel discharge tube 107 by press fitting. The nozzle member is coupled to a left rear portion of the fuel receiving tubular portion 71 (see FIG. 3) by snap-fitting. The fuel discharge tube 107 is bent in a U-shape.

As shown in FIG. 5, a contour of the pressure regulator 62 has a substantially cylindrical columnar shape. The pressure regulator 62 serves to regulate the pressure of the pressurized fuel discharged from the fuel pump 58, i.e., the pressure of fuel to be supplied to an engine, at a predetermined pressure.

The pressure regulator case 64 may be made of resin and is formed to have a hollow cylindrical container shape. The regulator case 64 includes a first case half 112 and a second case half 113 divided in the axial direction thereof. The case halves 112, 113 are coupled by a snap-fitting. The pressure regulator 62 is disposed in the regulator case 64. The regulator case 64 is disposed in a laterally placed state where the axial direction thereof extends horizontally.

A connected tubular portion 115 and a fuel discharge portion 116 are formed on the first case half 112. The connected tubular portion 115 has a hollow cylindrical shape projecting downwardly. The fuel discharge portion 116 projects outward from the upper end of the first case half 112 in the tangential direction. The connected tubular portion 115 and the fuel discharge portion 116 are in fluid communication with a fuel introduction port of the pressure regulator 62 within the first case half 112.

A discharge pipe portion 118 projecting downward from an end opposite to the first case half 112 is formed on the second case half 113 (see FIG. 5). The discharge pipe portion 118 is in fluid communication with a surplus fuel discharge port of the pressure regulator 62 disposed in the second case half 113. The fuel discharge portion 116 discharges the fuel, of which pressure is regulated in the pressure regulator 62. Surplus fuel from the pressure regulator 62 is discharged through the discharge pipe portion 118.

The connected tubular portion 115 of the regulator case 64 is fitted so as to be connected to the connecting tubular portion 100 of the pump case 60. An O-ring 119 is interposed between the connecting tubular portion 100 and the connected tubular portion 115 for sealing a gap therebetween. Further, the fuel discharge portion 116 protrudes from the upper end of the first case half 112 and is oriented to the rear left direction (see FIG. 4). The discharge pipe portion 118 is oriented to the inside of the fuel receiving tubular portion 71 of the sub-tank main body 66.

As shown in FIG. 5, a check valve 120 is included in the connecting tubular portion 100 of the pump case 60. The check valve 120 is configured to retain a residual-pressure so as to prevent backflow of pressurized fuel in the connecting tubular portion 100. The check valve 120 includes a valve guide 121 and a valve body 122, which are concentrically arranged. The valve guide 121 is fixedly disposed within the connecting tubular portion 100. The valve body 122 is disposed so as to be movable in the axial direction (i.e., the upward/downward direction) such that the check valve 120 is opened and closed according to the axial movement of the valve body 122. More specifically, when the valve body 122 moves downward under its own weight, the check valve 120 is closed. When the valve body 122 moves upward in response to the fuel pressure, the check valve 120 is opened.

As shown in FIG. 3, the engagement shaft 72 of the sub-tank main body 66 is rotatably inserted into the engagement hole 50 of the joint main body 46. As a result, the pump unit 26 is rotatably coupled to the joint member 24 so as to be rotatable about the engagement shaft 72 (see rotational directions indicated by arrows Y1, Y2 in FIG. 3). The fuel outlet port 37 in the flange main body 28 is connected to the fuel discharge portion 116 at the regulator case 64 via a discharge fuel pipe 124 (see FIG. 2). The discharge fuel pipe 124 may be made of a flexible resin hose or the like. Also, the discharge fuel pipe 124 may be formed in a bellows shape.

As shown in FIG. 2, the first electric connector portion 38 on the flange main body 28 may be electrically connected to an electric connector for the fuel pump 58 via a first wire harness 126. The second electric connector portion 39 on the flange main body 28 may be electrically connected to the gauge main body 84 of the sender gauge 56 (see FIG. 3) via a second wire harness 128. The first wire harness 126 and the second wire harness 128 may be properly hooked to a wiring hook portion, which is integrally formed with an adjacent resin member.

A characteristic structure of the present embodiment is a guide member 150 positioned on the fuel supply device 20, which may be formed as a module by connecting the flange unit 22 to the pump unit 26, to improve the insertability into the fuel tank 10. As shown in FIGS. 1 to 4, the guide member 150 is formed on the pump case 60 of the fuel pump 58 of the pump unit 26. More specifically, the guide member 150 is positioned on the case main body 94 of the pump case 60.

In embodiments where the guide member 150 is not provided, when the fuel supply device 20 is inserted into the fuel tank 10 through the opening formed by the opening periphery 13, a component of the pump unit 26 may be caught by the opening periphery 13. Thus, there is a possibility the fuel supply device 20 may not be inserted smoothly. More specifically, there is a possibility that the uneven shape of the regulator case 64 may be caught by the opening periphery 13. Therefore, the guide member 150 can be disposed at a position capable of protecting the regulator case 64 during the insertion process. The position capable of protecting the regulator case 64 during the insertion process is a position in which the guide member 150 abuts on the opening periphery 13 during the insertion process so as to prevent the regulator case 64 from contacting the opening periphery 13.

As shown in FIG. 6, the guide member 150 positioned on the upper surface of the case body 94 of the pump case 60 is generally aligned with and extends in the insertion direction of the pump unit 26. That is, the guide member 150 extends in the insertion direction of the pump unit 26. In this embodiment, the guide member 150 has a substantially triangular plate shape with a corner projecting upward toward the regulator case 64 (see FIG. 2), and is oriented parallel to the insertion direction of the fuel supply device 20. The guide member 150 may be made of resin or steel.

Figure 7:
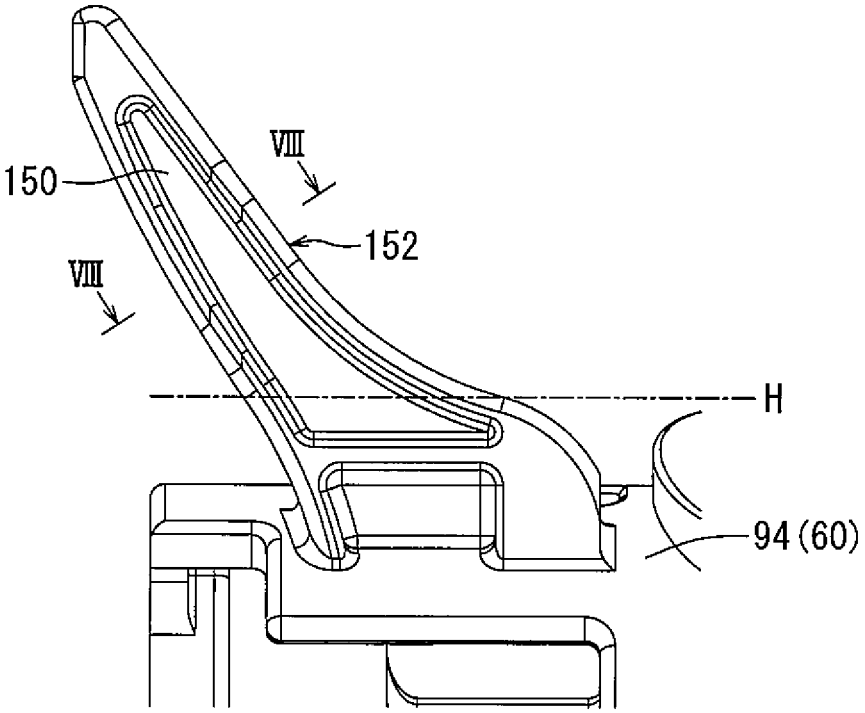
FIG. 7 is an enlarged, partial front view of the pump case of FIG. 6 illustrating the guide member.
Figure 9:
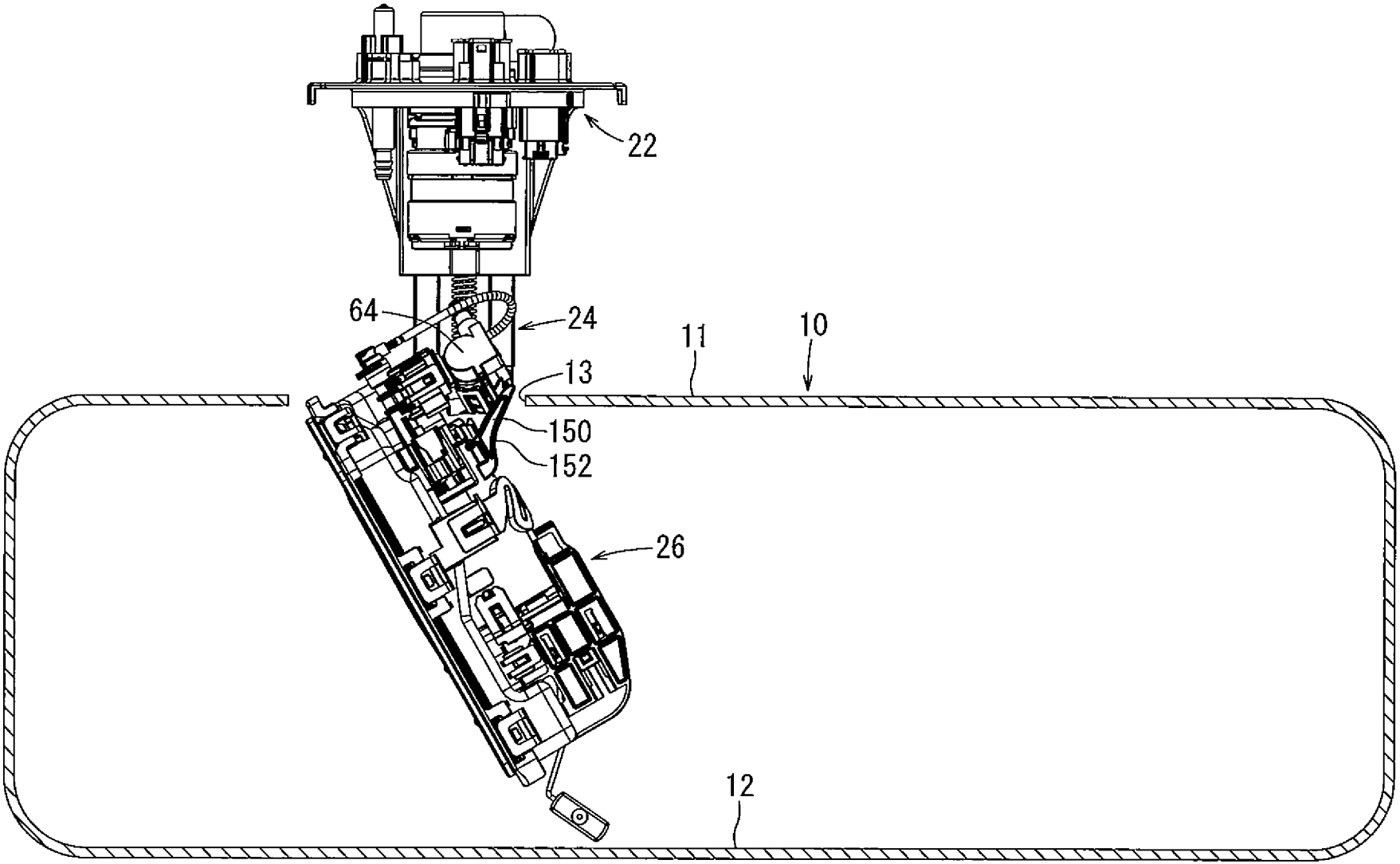
FIG. 9 is a side view of the fuel supply device of FIG. 1 during installation into a fuel tank through an opening formed in an upper wall of the fuel tank.

As shown in FIGS. 7 and 9, the guide member 150 includes a guide surface 152 for slidably contacting the opening periphery 13. The guide surface 152 is inclined upward to the left and has a curved concave shape defined by a concave surface. More specifically, the guide surface 152 is inclined upward with respect to a bottom surface of the pump unit 26 to the rear end side in the insertion direction of the pump unit 26. As shown in FIG. 9, the guide surface 152 generally curves in a direction away from the opening periphery 13 as viewed in a state where the guide member 150 passes through the opening of the upper wall 11. As shown in FIG. 7, the concave curved portion of the guide surface 152 extends radially to a height that is greater than the radially outermost point of the pump case 60 as viewed in a state where the fuel pump 58 is installed in the fuel tank 10. That is, the lower, leading end of the concave curved portion (the front end in the insertion direction of the pump unit 26) of the guide surface 152 is greater than the highest position of the pump case 60. In FIG. 7, the line H indicates the highest position of the pump case 60.

Figure 8:
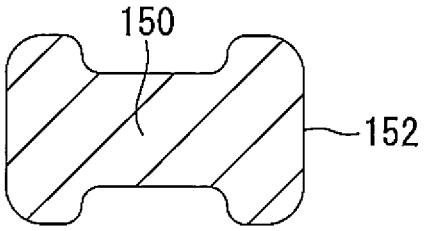
FIG. 8 is a cross-sectional view of the guide member of FIG. 7 taken along line VII-VII of FIG. 7.

FIG. 8 shows a cross-sectional view taken along line VIII-VIII of FIG. 7. As shown in FIG. 8, the portion of the guide surface 152 extending from the concave curved surface to the distal tip end portion of the guide surface 152 is generally planar and flat. More specifically, the contact portion of the guide surface 152 between the concave curved portion and the tip end portion is flat. The contact portion may be configured to contact the opening periphery 13 when the fuel supply device 20 is inserted into the fuel tank 10. The contact portion of the guide surface 152 may be formed in a flat shape.

Before explaining the advantages of the guide member 150 of the present embodiment, a typical installation method of the modular fuel supply device 20 in the fuel tank 10 will be described.

The fuel supply device 20 is extended when being installed in the fuel tank 10 (see FIG. 9). In this state, the joint member 24 is suspended by the flange unit 22 while the pump unit 26 is suspended by the joint member 24. Specifically, the joint member 24 is in its lowermost position (farthest position) with respect to the flange unit 22. Further, the pump unit 26 is rotated in an inclined state extending generally downward to right of the joint member 24 (see the arrow Y1 and the pump unit 26 depicted by two-dot chain line in FIG. 3).

Subsequently, the pump unit 26 is passed through the opening defined by the opening periphery 13 of the fuel tank 10 from its top while the fuel supply device 20 is still in its extended state. The pump unit 26 is mounted on the bottom wall 12 of the fuel tank 10 (see the pump unit 26 depicted by slid line in FIG. 2 and FIG. 3) by being rotated toward the upper right direction (see the arrow Y2 in FIG. 3) so as to be transitioned to a horizontal orientation. A rotation limiting mechanism for limiting rotation beyond the horizontal state of the pump unit 26 may be provided between the joint member 24 and the pump unit 26.

The fitting tubular portion 33 of the flange main body 28 is then fitted in the opening periphery 13 of the fuel tank 10 as the flange unit 22 is pressed downward against the biasing force of the spring 52. In this state, the flange portion 34 of the flange main body 28 is fixed to the upper wall 11 of the fuel tank 10 via fixing means (not shown), such as metal fixtures or bolts (see FIG. 2 and FIG. 3). The installation of the fuel supply device 20 to the fuel tank 10 is thus completed as described above.

The pump unit 26 is held in a state pressed against the bottom wall 12 of the fuel tank 10 via the biasing of the spring 52 in the installed state of the fuel supply device 20 (see FIG. 2 and FIG. 3). Further, the projections 81 on the cover member 68 abut the bottom wall 12 of the fuel tank 10, thereby ensuring flow of fuel between the cover member 68 and the bottom wall 12. A lower end face 41*a* of the standoff portion 41 of the flange unit 22 faces the upper end face 46*a* of the joint main body 46 at a predetermined distance therebetween (see FIG. 3).

Incidentally, the fuel tank may deform, i.e., expand or contract in response to a change in tank internal pressure caused by a change in temperature or a change in the amount of fuel. Consequently, the distance between the upper wall 11 and the bottom wall 12 of the fuel tank 10 may vary (increase or decrease). In this case, the flange unit 22 and the joint member 24 move relative to each other in the upward/downward direction so as to follow the change in the height of the fuel tank 10. Further, when the fuel tank 10 attempts to excessively contract, the standoff portion 41 of the flange main body 28 and the joint main body 46 come into contact with each other so as to prevent the height of the fuel supply device 20 from lowering further, thereby protecting the fuel supply device 20.

Further, a fuel feed pipe leading to an engine is connected to the fuel outlet port 37 of the flange unit 22. External connectors are each connected to the first electric connector portion 38 or the second electric connector portion 39. A fuel vapor piping member leading to a canister is connected to the evaporation port 36. The canister includes adsorbents (for example, activated carbon) for adsorbing and desorbing fuel vapor generated within the fuel tank 10.

The fuel pump 58 is driven by an external power source. The fuel from the interior of the fuel tank 10 that is to pass through the cover member 68 and/or fuel within the fuel storage space 79 of the pump unit 26 is drawn in by the fuel pump 58 via the fuel filter 67 and pressurized. The fuel pump 58 supplies the pressurized fuel into the regulator case 64 via the discharge pipe portion 96 of the pump case 60. In the regulator case 64, the pressure of the pressurized fuel is regulated by the pressure regulator 62. The fuel having regulated pressure is supplied to the engine through the discharge fuel pipe 124 and the fuel outlet port 37 of the flange unit 22. The surplus fuel resulting from regulation of the fuel pressure using the pressure regulator 62 is discharged through the discharge pipe portion 118 at the regulator case 64 into the fuel receiving tubular portion 71 of the sub-tank main body 66. Further, a portion of the pressurized fuel discharged from the fuel pump 58 into the discharge pipe portion 96 of the pump case 60 is discharged into the fuel receiving tubular portion 71 of the sub-tank main body 66 via the fuel discharge tube 107. The fuel vapor generated in the fuel tank 10 is discharged into the canister when a fuel vapor control valve of the fuel vapor valve 30 opens.

As described above, the fuel supply device 20 is installed by being inserted into the fuel tank 10 in a state in which the pump unit 26 and the flange unit 22 are coupled and modularized. As shown in FIG. 9, the fuel supply device 20 is inserted through the opening formed by the opening periphery 13 of the upper wall 11 of the fuel tank 10. If the fuel supply device 20 does not include the guide member 150, one or more components of the fuel supply device 20 may be caught by the opening periphery 13 during the insertion process, and the insertion of the fuel supply device 20 may be hindered. More specifically, in the case of the fuel supply device 20 that does not include the guide member 150, the uneven portions and surfaces along the outside of the regulator case 64 of the pump unit 26 may be caught by the opening periphery 13 during the insertion process, so that the insertion of the fuel supply device 20 may be restricted and/or prevented.

In embodiments disclosed herein, the pump case 60 includes the guide member 150 at a position to protect the regulator case 64 during the insertion process of the fuel supply device 20 into the fuel tank 10. As shown in FIGS. 6 and 7, the guide surface 152 of the guide member 150 may come into contact with the opening periphery during insertion so as to smoothly guide the pump case 60 and fuel supply device 20. For example, as shown in FIG. 9, when the modularized fuel supply device 20 passes through the opening of the fuel tank 10, the guide surface 152 of the guide member 150 comes into contact with the opening periphery 13 such that the fuel supply device 20 is guided and that the regulator case 64 is prevented from coming into contact with the opening periphery 13. As a result, the fuel supply device 20 can be smoothly inserted into the fuel tank 10 without being caught by the opening periphery 13.

The guide surface 152 of the guide member 150 of the present embodiment includes a concavely curved portion in the insertion direction. More specifically, in a cross section that is parallel to the longitudinal direction of the guide surface 152 and is perpendicular to the guide surface 152, the guide surface 152 includes a concavely curved portion defined by a concave surface. Due to the concavely curved portion, when the pump unit 26 of the fuel supply device 20 passes through the opening of the fuel tank 10, an insertion gap, that is, a gap between the fuel supply device 20 and the opening periphery 13 becomes larger as compared to when the guide surface 152 of the guide member 150 is not curved. Therefore, the insertion gap becomes relatively large, so that the insertability of the fuel supply device 20 can be further improved.

Further, the concave curved portion of the guide surface 152 of the guide member 150 may be formed from the position higher than the highest position of the pump case 60 as viewed in a state where the pump unit 26 is installed in the fuel tank 10. Thus, when the pump unit 26 passes through the opening of the fuel tank 10, the guide member 150 first comes into contact with the opening periphery 13 at a position higher than the highest position of the pump case 60. Therefore, the guide surface 152 of the guide member 150 is curved in a concave shape from the position on which the opening periphery 13 first abuts during insertion, so that the above-described action of improving the insertability can be reliably performed.

As shown in FIG. 8, the contact surface of the guide surface 152 of the guide member 150 that abuts the opening periphery 13 may extend linearly between the lateral sides of the guide member 150. Therefore, when the pump unit 26 passes through the opening of the fuel tank 10, the opening periphery 13 abuts on both edges of a flat surface portion of the guide surface 152 and slides, thereby preventing rattling.

Although the specific embodiment of the present disclosure has been described, the present disclosure can be implemented in various other modes.

For example, the present disclosure is not limited to the fuel supply device 20 of a vehicle (e.g., an automobile) and may be applied to other fuel supply devices.

Further, the concavely curved portion of the guide surface 152 of the guide member 150 may be formed by a plurality of short planar surfaces arranged side-by-side.

Further, the guide member 150 may be provided on a component of the pump unit 26 other than the pump case 60. That is, the guide member 150 only needs to prevent other components of the fuel supply device 20 from being caught by the opening periphery 13 when the fuel supply device 20 is inserted into the fuel tank 10.

Further, the contact surface of the guide surface 152 of the guide member 150 that comes into contact with the edge portion of the opening periphery 13 may not have to have to be linear between the lateral sides of the guide member 150 in cross-section. For example, the contact surface may have a curved shape between the lateral sides of the guide member 150 in cross-section. However, in that case, the advantage resulting from the above-described linear cross-sectional shape cannot be obtained.

Further, the guide surface 152 of the guide member 150 may be formed such that the guide surface 152 is recessed toward the engagement shaft 72 rotatably coupling the flange unit 22 and the pump unit 26 to each other.

The technology has been disclosed herein in various aspects. One aspect of the present disclosure is a fuel supply device to be inserted into a fuel tank through an opening defined by an opening periphery of an upper wall of the fuel tank. The fuel supply device has a flange unit including a cover plate configured to close the opening of the upper wall of the fuel tank, and a pump unit connected to the flange unit so as to be relatively movable in an upward/downward and rotatable. The pump unit includes a fuel pump configured to be disposed to face a bottom wall of the fuel tank. The pump unit includes a guide member arranged in an insertion direction. The guide member is configured to abut on the opening periphery so as to guide the pump unit when the pump unit is inserted into the fuel tank. A guide surface of the guide member is configured to abut on the opening periphery and includes a concavely curved portion defined by a concave surface.

According to the above aspect, the pump unit of the fuel supply device includes the guide member. The guide member is formed such that the guide surface of the guide member comes into contact with the opening periphery so as to guide the pump unit when the pump unit is inserted into the fuel tank through the opening. This allows the fuel supply device to be smoothly inserted into the fuel tank without being caught by the opening periphery.

In addition, according to the above aspect, the guide surface of the guide member has a concavely curved portion defined by a concave surface. Therefore, when inserting the pump unit through the opening, an insertion gap, i.e., a gap defined between the opening periphery and the pump unit becomes larger by a gap formed by the concavely curved portion of the guide member compared with the case where the guide surface of the guide member is formed in a straight shape. As a result, the pump unit can be inserted into the fuel tank with a margin such that the insertability can be further improved.

A second aspect is the fuel supply device of the first aspect, in which the guide member is provided on a pump case housing the fuel pump therein. The guide surface is curved from a position higher than a highest position of the pump case in a state where the pump unit is installed in the fuel tank.

According to the second aspect, the guide surface is concavely curved from the positon higher than the highest position of the pump case. So, when the pump unit passes through the opening, the opening periphery first abuts on the guide member at a position higher than the highest position of the pump case. Therefore, the guide surface is concavely curved from the position on which the opening periphery first abuts while the pump unit passes through the opening, so that the above-described action of improving the insertability can be reliably performed.

A third aspect is the fuel supply device of the first aspect or the second aspect, in which the guide surface includes a contact surface configured to come into contact with the opening periphery when the pump unit is inserted into the fuel tank. The contact surface is linear in cross-section between the lateral sides of the guide member.

According to the third aspect, the contact surface of the guide member is linear in cross-section between the lateral sides of the guide member. Therefore, it is possible to slide the guide member while the guide member is brought into contact with the opening periphery, thereby preventing rattling.

What is claimed is:

1. A fuel supply device to be inserted into a fuel tank in an insertion direction through an opening defined by an opening periphery of an upper wall of the fuel tank, comprising:

a flange unit including a cover plate configured to close the opening of the upper wall of the fuel tank;

a pump unit movably coupled to the flange unit and configured to move in an upward/downward direction and rotate relative to the flange unit, the pump unit including a fuel pump configured to face a bottom wall of the fuel tank; and a guide member coupled to the pump unit, wherein the guide member includes a concave guide surface configured to abut the opening periphery and guide the pump unit when the pump unit is inserted into the fuel tank;

wherein the guide member has a side coupled to and extending along the pump unit, wherein the guide member has a length measured from a first end of the guide member to a second end of the guide member along the side of the guide member and a height measured perpendicularly from the pump unit, wherein the height of the guide member is greater than the length of the guide member.

2. The fuel supply device according to claim 1, wherein:

the guide member extends from a pump case that houses the fuel pump therein; and the guide surface is curved from a position higher than a highest position of the pump case in a state where the pump unit is installed in the fuel tank.

3. The fuel supply device according to claim 1, wherein:

the guide surface is linear in cross-section between lateral sides of the guide member.

4. The fuel supply device of claim 1, comprising:

a joint member coupled to the flange unit, wherein the pump unit is rotatable coupled to the joint member about an axis of rotation;

wherein the guide surface of the guide member is recessed toward the axis of rotation.

5. The fuel supply device of claim 1, wherein the pump unit comprises a fuel filter positioned on a first side of the pump unit, wherein the guide member is coupled to the pump unit on a second side of the pump unit, and wherein the second side is opposite the first side.

6. A fuel supply device to be inserted into a fuel tank in an insertion direction through an opening defined by an opening periphery of an upper wall of the fuel tank, comprising:

a flange unit including a cover plate configured to close the opening of the upper wall of the fuel tank;

a joint member coupled to the flange unit;

a pump unit pivotably coupled to the joint member about a shaft such that the pump unit may pivot about the shaft relative to the joint member, and wherein the pump unit includes a fuel pump; and a guide member coupled to the pump unit, wherein the guide member includes a concave guide surface that is recessed toward the shaft, wherein the guide surface is configured to abut the opening periphery to guide the pump unit when the pump unit is inserted into the fuel tank;

wherein the guide member has a side coupled to and extending along the pump unit, wherein the guide member has a length measured from a first end of the guide member to a second end of the guide member along the side of the guide member and a height measured perpendicularly from the pump unit, wherein the height of the guide member is greater than the length of the guide member.

7. The fuel supply device of claim 6, wherein the pump unit comprises a fuel filter positioned on a first side of the pump unit, wherein the guide member is coupled to the pump unit on a second side of the pump unit, and wherein the second side is opposite the first side.

8. The fuel supply device of claim 6, wherein the guide member extends from a pump case that houses the fuel pump therein.

9. The fuel supply device of claim 6, wherein the guide surface is linear in cross-section between lateral sides of the guide member.

* * * * *